United States Patent [19]

Matsushita et al.

[11] Patent Number: 4,563,947

[45] Date of Patent: Jan. 14, 1986

[54] INK DETECTING DEVICE FOR ROTARY PRINTER

[75] Inventors: Ken Matsushita; Hiroki Ikeda; Yoshihide Sugiyama, all of Wakayama, Japan

[73] Assignees: Duplo Seiki Corporation, Wakayama; Duplo Manufacturing Corporation, Komae, both of Japan

[21] Appl. No.: 696,066

[22] Filed: Jan. 29, 1985

[30] Foreign Application Priority Data

Feb. 1, 1984 [JP] Japan ..... 59-17739

[51] Int. Cl.[4] ..... B41F 15/40; B41F 31/02

[52] U.S. Cl. ..... 101/122; 101/363

[58] Field of Search ..... 101/119, 120, 121, 122, 101/123, 124, 207, 208, 210, 350, 364, 363, DIG. 24; 73/150 R

[56] References Cited

U.S. PATENT DOCUMENTS

| | | | |
|---|---|---|---|
| 3,442,121 | 5/1969 | Wirz | 73/150 R |
| 3,730,089 | 5/1973 | McCutcheon | 101/DIG. 24 |
| 3,762,324 | 10/1973 | Ivary | 101/DIG. 24 |
| 4,312,270 | 1/1982 | Gates | 101/122 |
| 4,446,791 | 5/1984 | Stevens et al. | 101/DIG. 24 |

*Primary Examiner*—J. Reed Fisher

*Attorney, Agent, or Firm*—Burns, Doane, Swecker and Mathis

[57] ABSTRACT

For use in a rotary printing machine comprising at least one rotary drum, an image carrier medium having an image area to be printed on an image supporting material, and a printing ink supply unit, an ink detecting device which comprises a plurality of sensor rolls rotatably supported in series on a single fixed shaft in frictional contact with the printing drum through a layer of printing ink interposed between said sensor rolls and said printing drum a first means for separately detecting rotational speed of each sensor rolls, a second means for detecting rotational speed of the printing drum, and a control means for comparing the rotational speed of each sensor roll, under the influence of the slip between the sensor rolls and the printing drum, and corresponding reference values respectively indicative of rotational speed of each sensor roll measured under such a condition that optimum quantity of printing ink is applied on the outer periphery of the printing drum, and accordingly controlling said ink supplying means so as to replenish the printing ink onto corresponding portions of the outer periphery of the printing drum which correspond to some sensor rolls the rotational speed of which exceeds the corresponding reference values.

7 Claims, 9 Drawing Figures

INK DETECTING DEVICE FOR ROTARY PRINTER

BACKGROUND OF THE INVENTION

The present invention generally relates to a rotary printing machine and, more particularly, to an ink detecting device for use in the rotary printing machine for detecting the quantity of a printing ink supplied onto an outer periphery of printing drum.

There is known a rotary printing machine of a type wherein, during the rotation of the printing drum, a printing ink supplied onto the outer periphery of the printing drum is allowed to penetrate through the image area of the stencil to a paper positioned on one side of the stencil opposite to the drum and being moved in same direction in synchronism with the rotation of the drum. With this known rotary printing machine, the printing ink has to be replenished with a predetermined quantity upon a time predetermined number of papers have been printed, or the printing ink has to be manually replenished occasionally depending on the tone or the quality of the printed image on the papers being monitored by the attendant operator. The replenishment of the printing ink against the predetermined number of the papers printed or the manual replenishment of the printing ink against the tone or the quality of the printed image on the paper is disadvantageous not only in that the image can not be uniformly printed on all of the papers, but also in that it is a time-consuming and tiresome procedure.

In view of the above, an ink detecting device for detecting the quantity of ink remaining on the outer periphery of the printing drum has been devised and disclosed in, for example, the first Japanese Patent Publication No. 58-74361, published on May 4, 1983. According to this publication, the ink detecting device comprises a plurality of sensor rolls, each of which is so fixedly mounted on a corresponding shaft, rotatably supported by a machine framework, as to be in frictional contact with a corresponding portion of an outer periphery of an applicator roll and also as to be moved together with the shaft in one axial direction thereof due to the ink layer on the applicator roll during the operation of the printing machine, the shifted length of each sensor roll being proportional to the thickness of the ink layer. The printing ink is controlled to be replenished from an ink supplying device onto a corresponding portion of outer peripheral surface of the printing drum when the shifted length of each sensor roll falls below a predetermined reference value.

Meanwhile, it is well known that the more the temperature of the printing ink is low, the more the viscosity thereof become high so that, when the temperature of the printing ink is lower than normal, the printing ink is required to be replenished on the printing drum much more than normal. In such case, however, with this known ink detecting device, since the thickness of the printing ink with viscosity higher than normal is generally regarded to be larger than normal dimension, namely, since it is regarded that the sufficient quantity of the printing ink remains on the corresponding portion of the printing drum, it disadvantageously results in that the printing ink can not be replenished onto the printing drum sometimes although it should be replenished. While, according to above prior art, when the temperature of the printing ink is higher than the normal one, since the viscosity of the printing ink is lower than normal, the printing ink is disadvantageously possibly replenished too much onto the printing drum.

SUMMARY OF THE INVENTION

The present invention has been devised with a view to substantially eliminating the above discussed disadvantages and inconveniences inherent in the prior art ink detecting device and has for its essential object to provide an improved ink detecting device for use in a rotary printing machine, which, after detecting the thickness and, hence the quantity, of the printing ink on the outer periphery of the printing drum, controls an ink supplying means so as to replenish proper quantity of the printing ink onto the desired portions of the outer periphery of the printing drum while taking the temperature of the printing ink in consideration.

Another important object of the present invention is to provide an improved ink detecting device of the type referred to above which is simple in construction and has high reliability.

To this end, the present invention provides an improved ink detecting device which comprises a plurality of sensor rolls rotatably supported in series on a single fixed shaft in frictional contact with the printing drum through a layer of printing ink interposed between said sensor rolls and said printing drum, a first means for separately detecting rotational speed of each sensor rolls, a second means for detecting rotational speed of the printing drum, and a control means for comparing the rotational speed of each sensor roll and corresponding reference values respectively indicative of rotational speed of each sensor roll measured under such a condition that optimum quantity of printing ink is applied on the outer periphery of the printing drum, and accordingly controlling an ink supplying means so as to replenish the printing ink onto desired portions of the outer periphery of the printing drum which correspond to some sensor rolls the rotational speed of which exceeds the corresponding reference values.

With the construction of the ink detecting device according to the present invention, as described above, assuming that some portions of the outer periphery of the printing drum become shortage of printing ink, the rotational speed of the corresponding sensor rolls increases because that the slippage of said sensor roll to the printing drum decreases, so that the control means, after comparing the rotational speed of said sensor rolls and its reference value, when the former is regarded to exceed the latter, controls the ink supplying means so as to replenish the printing ink onto the corresponding portions of the printing drum. Moreover, when the temperature of the printing ink is lower than normal, the slippage between the sensor rolls and the printing drum decreases due to the high viscosity of the printing ink, and accordingly the rotational speed of the sensor rolls become higher than normal, so that the printing ink is advantageously replenished from the ink supplying means onto the outer periphery of the printing drum with quantity larger than normal. In addition, since the sensor rolls are mounted on a single fixed shaft, the construction for detecting the revolution thereof can be very simple and compact.

BRIEF DESCRIPTION OF THE DRAWINGS

These and other objects and features of the present invention will become clear from the following description taken in conjunction with a preferred embodiment of the present invention with reference to the accompanying drawings, in which.

DETAILED DESCRIPTION OF THE EMBODIMENT

Figure 1:
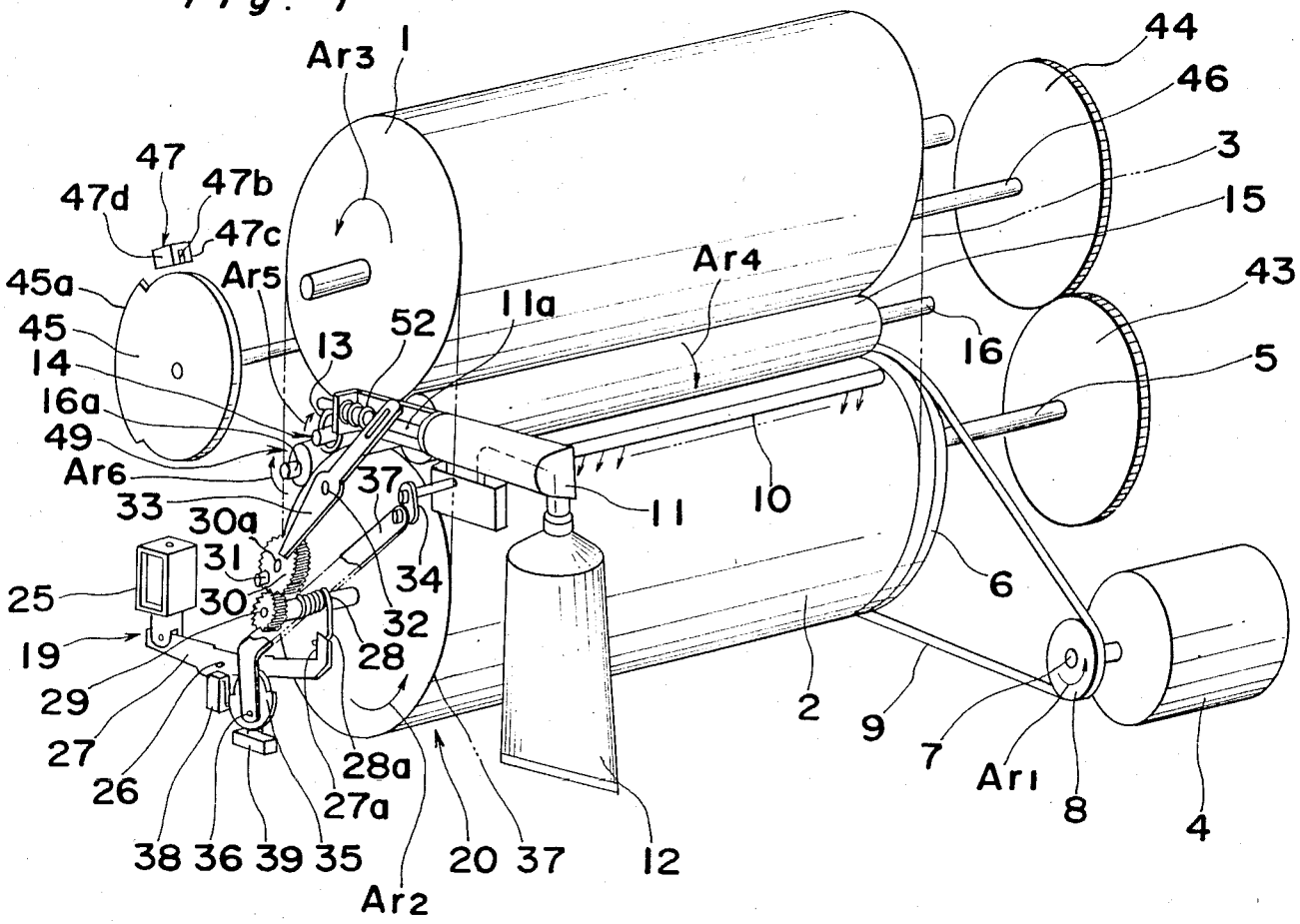
FIG. 1 is a schematic perspective view of a rotary printing machine embodying the present invention.

Before the description of the present invention proceeds, it is to be noted that like parts are designated by like reference numerals throughout the accompanying drawings.

Figure 2:
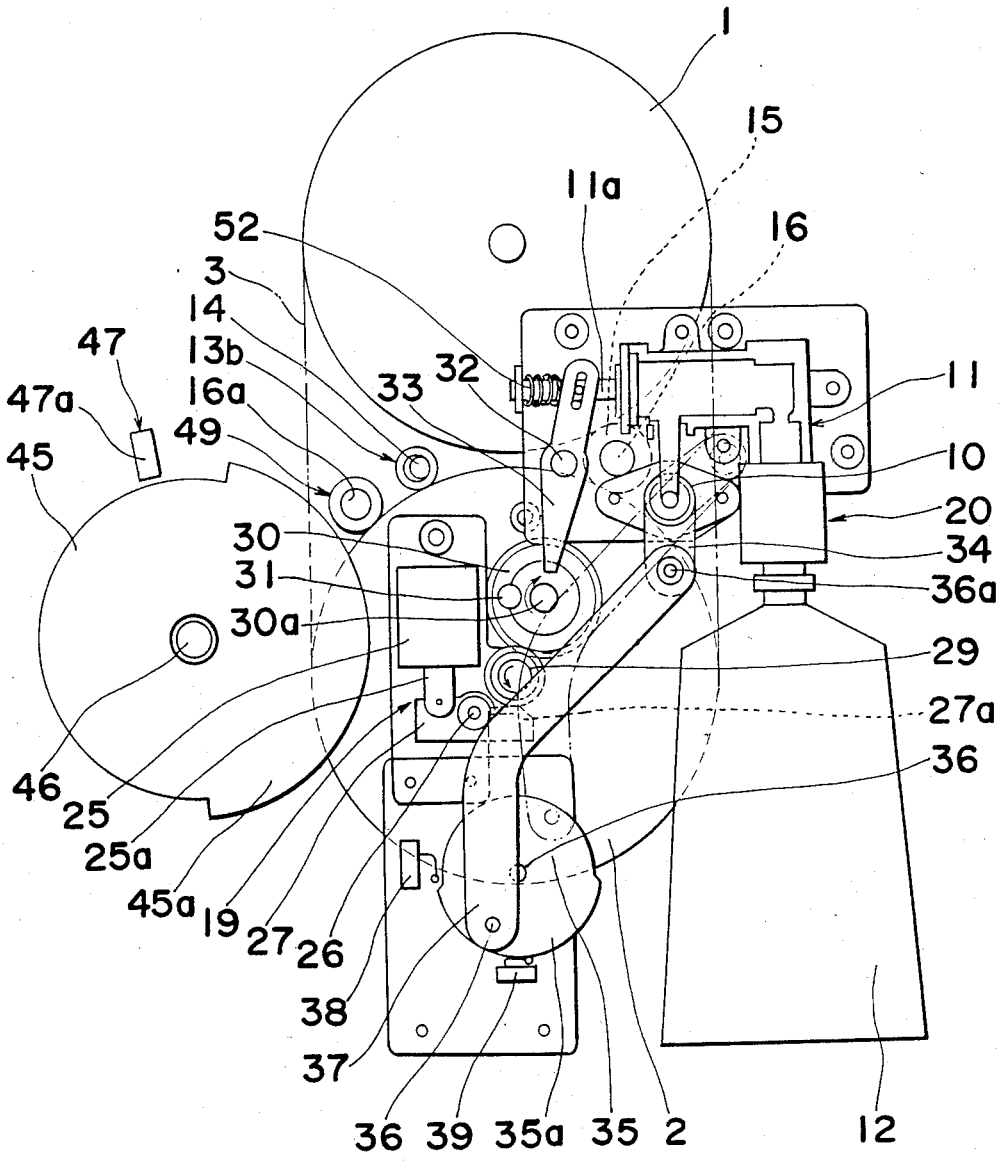
FIG. 2 is a side elevational view of the rotary printing machine shown in FIG. 1.

Referring first to FIGS. 1 and 2 showing a rotary printing machine to which the present invention is applicable, the machine shown therein comprises a pair of juxtaposed, upper and lower drums 1 and 2 supported one above to the other in any known manner by a machine framework (not shown), and a generally endless back-up screen 3 trained and stretched between the upper and lower drums 1 and 2. The lower drum 2 is mounted on a shaft 5 for rotation together therewith, said shaft 5 having a pulley 6 which is rigidly mounted thereon and is drivingly coupled to a drive pulley 8, rigidly mounted on a drive shaft 7 of an electrically operated motor 4, by means of a generally endless belt 9. Thus, it will readily be seen that, when and so long as the drive shaft 7 and, hence, the drive pulley 8, is rotated in one direction shown by the arrow Ar1, the lower drum 2 is rotated in one direction shown by the arrow Ar2 accompanied by the corresponding rotation of the upper drum 1 in the same direction Ar3 as the direction Ar2 of rotation of the lower drum 2 with the back-up screen 3 travelling in one direction around the upper and lower drums 1 and 2.

The machine shown therein also comprises a generally pipe-shaped, perforated ink distributor 10 having a length generally equal to the length of the lower drum 2. This ink distributor 10 is so supported inwardly of the back-up screen 3 by the machine framework as to permit the row of the equally spaced perforations to confront the outer peripheral surface of the lower drum 2. The ink distributor 10 has one end closed and the other end fluid-coupled to a discharge port of a pumping unit 11 having its inlet port adapted to be removably coupled with a source of printing ink. The distributor 10 will be described in more detail later. So far shown, the source of printing ink is constituted by a flexible tube 12 filled with printing ink and having one end adapted to be fluid-connected to the inlet port of the pumping unit 11. While the pumping unit 11 will be described in detail later, the printing ink supplied to the ink distributor 10 from the tube 12 through the pumping unit 11 emerges outwardly from the perforations in the distributor 10 onto the outer peripheral surface of the lower drum 2, the deposits of the printing ink on the outer peripheral surface of the lower drum 2 being subsequently uniformly spread over the outer peripheral surface of both of the drums 1 and 2 by a first applicator roll 15 during the continued rotation of the lower drum 2 in the direction Ar2 to form a substantially uniform layer of ink on the outer peripheral surface of both the lower drum 2 and the upper drum 1. The first applicator roll 15 is positioned inwardly of the back-up screen 3 and on the leading side of the ink distributor 10 with respect to the direction of rotation of the lower drum 2 and mounted on a support shaft 16 which is journaled at its ends to the machine framework so as to resiliently urge the first applicator roll 15 with its outer periphery contacting the outer peripheral surface of both of the drums 1 and 2. Thus, during the rotation of the lower drum 2 in the direction Ar2, the first applicator roll 15 rotates in frictional contact with any one of the upper and lower drums 1 and 2, but in a direction counter to the direction Ar2 or Ar3 of rotation of the upper or lower drum, as shown by the arrow Ar4 with the ink deposits, which have emerged onto the outer peripheral surface of the lower drum 2 from the respective perforations in the ink distributor 10, being consequently uniformly spread by the applicator roll 13 to form the ink layer of substantially uniform thickness over the outer peripheral surface of both of the upper and lower drums 1 and 2, as described hereinbefore. In addition, there is provided a second applicator roll 49 which is positioned inwardly of the back-up screen 3 and on a side opposite to the first applicator roll 15 with respect to an imaginary vertical plane passing through the central axes of the upper and lower drums 1 and 2 and which is mounted on a support shaft 16*a*. The support shaft 16*a* is journaled at its ends to the machine framework so as to resiliently urge the second applicator roll 49 with its outer periphery contacting the outer peripheral surface of lower drum 2 in order to further form the ink layer over the outer peripheral surface of the lower drum 2 which has first formed by the first applicator roll 15.

Figure 7:
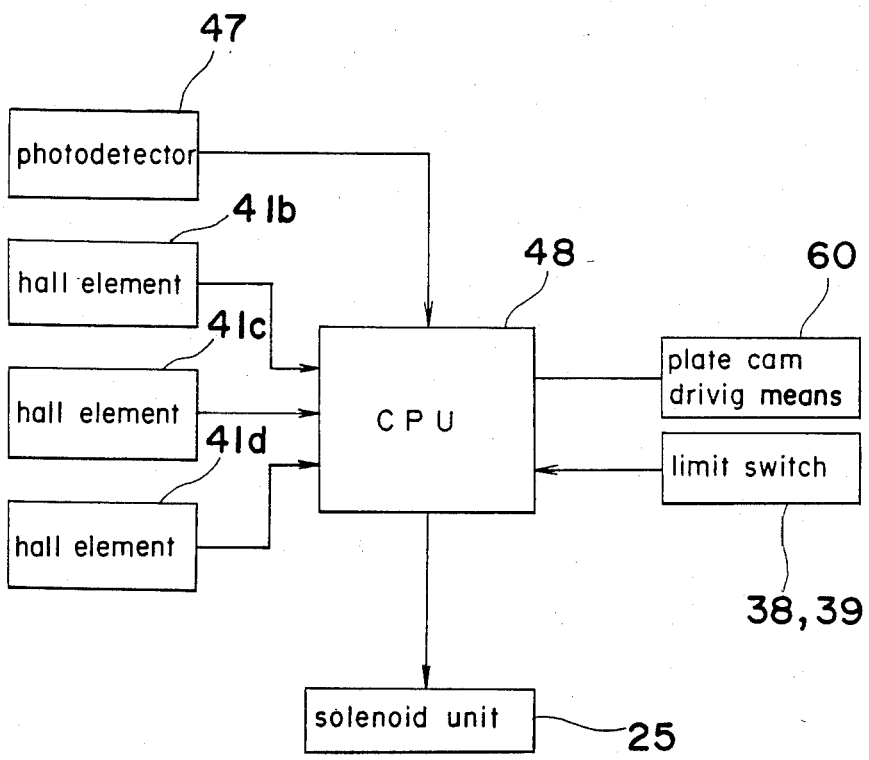

The pumping unit 11 so far shown is of a design that the reciprocal movement of a piston rod 11*a* can result in the flow of the ink from the inlet port to the outlet port, the reciprocal movement of the piston rod 11*a* being effected by the rotation of the lower drum 2 through an actuating mechanism 19 when and so long as a solenoid unit 25 is, for example, energized electrically in response to a control output signal generating from a central processing unit (CPU) 48 shown in FIG. 7 and as will be described later.

Referring still to FIGS. 1 and 2, the actuating mechanism 19 comprises a rocker arm 33 having an upper end loosely coupled with the piston rod 11*a*, a substantially intermediate portion thereof being rotatably mounted on a bearing pin 32 fast with the machine framework, a drive gear 29 operatively coupled with one end of the shaft 5 remote from the pulley 5 through a clutch 28, and a driven gear 30 constantly held in mesh with the drive gear 29 and having a transmission pin 31 extending outwardly therefrom in a direction parallel to the axis of rotation of said gear 30 so as to be engageable with the lower end of the locker arm 33. The driven gear 30 is also supported with a bearing pin 30*a* fast with the machine framework. In addition, the piston rod 11*a* is constantly urged together with the upper end of the rocker arm 33 in one direction by a spring 52 so as to take the retracted position to the body of the pumping unit 11. The actuating mechanism 19 so far described operates in such a manner that, when the drive gear 29 is coupled with the shaft 5 through the clutch 28, as will be described later, and is therefore, rotated together with the lower drum 2, the driven gear 30 is rotated in a direction counter to the direction of the drive gear 29 together with the transmission pin 31 while, consequent upon the revolution of the transmission pin 31 about the axis of rotation of the driven gear 30, the transmission pin 31 engages the lower end of the rocker arm 33 so as to swing about the bearing pin 32 accompanied by the linear reciprocating motion of the piston rod 11*a*.

The clutch referred to above and so far shown is of any known construction, for example, a slip-spring clutch including a coil spring having one end secured to and retained on the hub of the drive gear 29 and the other end 28*a* extending radially outwardly therefrom for selective engagement with a trigger lever 27. The trigger lever 27, pivotally supported at a substantially intermediate portion thereof by a bearing pin 26 fast with the machine framework, has one end pivotally coupled with a plunger 25*a* of the solenoid unit 25 and is formed with a pawl 27*a* adjacent the other end thereof, said pawl 27*a* protruding laterally outwardly therefrom for engagement with the end 28*a* of the coil spring 28. The clutch 28 is of such a design that, when and so long as the end 28*a* of the spring 28 is trapped by and engaged with the pawl 27*a* of the trigger lever 27, the clutch is in a decoupling position with no drive being transmitted from the lower drum 2 to the drive gear 29, but when and so long as the pawl 27*a* is disengaged from the end 28*a* of the spring 28, the clutch is in a coupling position with the drive being transmitted from the lower drum 2 to the drive gear 29.

The plunger 25*a* of the solenoid unit 25 is movable between retracted and projected positions, but is normally biased to assume the projected position during the absence of the control output signal from the CPU 48. Thus, when no control output signal is applied to the solenoid unit 25, the pawl 27*a* of the trigger lever 27 is held in position to engage the end 28*a* of the spring 28, and the clutch consequently held in the decoupling position.

Although not shown, the machine further comprises a presser roll positioned beneath the lower drum 2 to provide a nipping area at which an actual printing work takes place as a paper is fed therethrough. As is well known to those skilled in the art, the presser roll (not shown) is in practice supported for movement in a direction close to and away from the lower drum 2 and can be brought close to the lower drum 2 at the timing the paper is to pass through the nipping area, for the purpose of avoiding any possible contamination of the outer periphery of the presser roll which would occur when it contacts the lower drum 2.

When the rotary printing machine of the construction described hereinbefore is in use for making prints of an image, a stencil paper having a replica of the image to be printed has to be applied over the back-up screen 3 in any known manner although means for supporting the stencil paper to the back-up screen 3 is not illustrated. With the image bearing stencil paper so applied to the back-up screen 3, and when the motor 4 is driven to rotate the drums 1 and 2 in the same direction Ar3 and Ar2 and assuming that respective layers of ink have been formed on the outer peripheral surfaces of the drums 1 and 2, the printing ink retaining on the outer peripheral surface of any one of the drums 1 and 2 penetrates through the screen 3 and then through the image area of the stencil paper. The printing ink running outwardly through the image area of the stencil paper is subsequently transferred onto a paper as the latter passes through the nipping area between the lower drum 2 and the presser roll while having been pressed to contact the lower drum 2 through the stencil paper and the back-up screen 3. In this way, the image can be printed on the paper.

Eventually, as a certain number of papers have been printed, the quantity of the ink retaining on the outer peripheral surface of any one of the drums 1 and 2 decreases and the image being printed then becomes thin, diverting from the tone of the same image printed on the paper at the beginning of the printing work. Once this occur, the printing ink has to be replenished from the tube 12 onto the outer peripheral surface of the lower drum 2 through the ink distributor 10 by means of the pumping unit 11. According to the present invention, the replenishment of the printing ink can be performed automatically in response to the decrease of the quantity of the printing ink retaining on the outer peripheral surface of at least the lower drum 2 and, for this purpose, the ink detecting device is employed which will now be described with particular reference to FIGS. 1 and 2.

Figure 3:
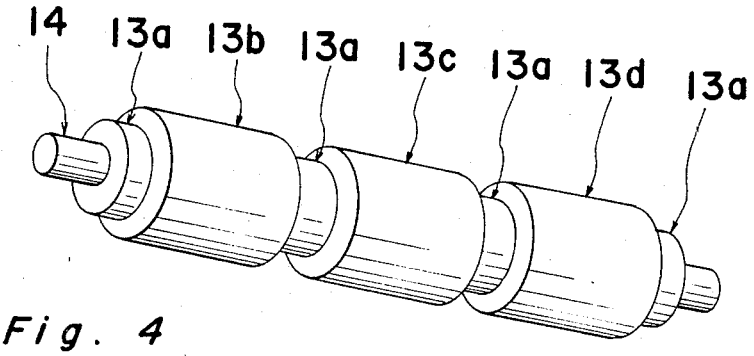
FIG. 3 is a perspective view indicating sensor rolls and spacers mounted on a fixed shaft which are employed in the rotary printing machine shown in FIGS. 1 and 2.
Figure 4:
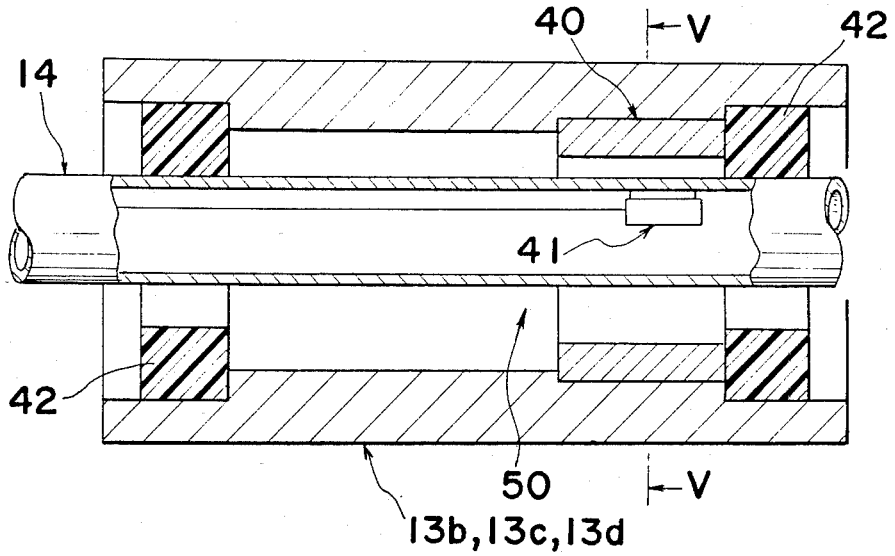
FIG. 4 is a sectional view of one of the sensor rolls and the fixed shaft shown in FIG. 3.
Figure 5:
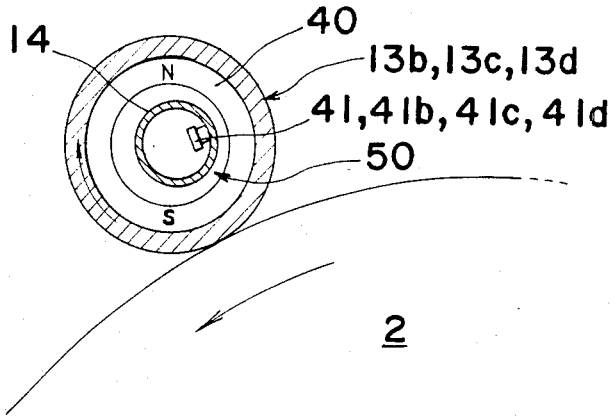
FIG. 5 is a sectional view taken along a line V—V in FIG. 4.

Referring to FIGS. 3, 4 and 5, the ink detecting device comprises three sensor rolls 13*b*, 13*c* and 13*d* respectively rotatably mounted in series on a fixed shaft 14 the both ends of which are supported by the machine framework so as to extend in parallel to the longitudinal axis of any one of the upper drum 1, the lower drum 2 and the applicator roll 15 and positioned inwardly of the back-up screen 3 above the second applicator roll 49. This sensor rolls 13*b*, 13*c* and 13*d* are respectively loosely mounted on the fixed shaft 14 so as to be able to in frictional contact with the outer periphery of the lower drum 2 under gravitation thereof. Each sensor roll has a pair of bearing members 42, preferably made of plastic such as tefln, which are respectively fixed on the inner surface of the sensor roll at both of end portions thereof, and the inner diameter of which are sufficiently larger than the outer diameter of the fixed shaft 14, preferably by 0.2 to 2 mm, so that the sensor rolls can move in a radial direction according to the thickness of the ink layer on the lower drum 2 and rotate about the fixed shaft 14 in a direction shown by the arrow Ar5 with being in contact with the lower drum 2. The three sensor rolls 13*b*, 13*c* and 13*d* are interposed by spacers 13*a* so as to be maintained a sufficiently large clearance therebetween in order to prevent the ink on the lower drum 2 from invading into the space between the fixed shaft 14 and the bearing members 42 through the clearance between the opposed end faces of the adjacent sensor rolls by capillary action. The clearance to be maintained between the sensor rolls by the spacers 42 should be set at least 1 mm, preferably about 10 mm.

The ink detecting device further comprises revolution detecting means 50 for detecting the revolution or rotational speed of each sensor roll 13*b*, 13*c* and 13*d*. The revolution detecting means is provided with each of sensor rolls 13*b*, 13*c* and 13*d* and includes an magnetic ring 40 fast on the inner surface of the each sensor roll surrounding the fixed shaft 14 and a sensor sensitive to the magnet, for example a hall element 41, fast on the inner surface of the pipe-shaped fixed shaft 14. During the rotation of each sensor roll, hence, each magnetic ring 40, the corresponding hall element 41 generates a speed signal indicative of the number of revolution of the sensor roll, the voltage of which varies in sine wave according to the revolution of the sensor roll. The speed signals generated in each of hall elements 41 are respectively supplied into the CPU 48, as shown in FIG. 7.

The ink detecting device still further comprises another revolution detecting means for detecting the revolution or rotational speed of the lower drum 2, which is described in detail hereinafter. A rotational shaft 46 is supported outwardly of the back-up screen 3, at a side remote the first applicator roll 15 with respect the imaginary vertical plane passing through the central axes of the upper and lower drums 1 and 2, by the machine framework in parallel to the lower drum 2. The rotational shaft 46 has an end on which there is provided with a driven gear 44 in mesh with a drive gear 43 mounted on a corresponding end of the shaft 5. Meanwhile, a rotational disk 45 is fixedely mounted on the other end of the rotational shaft 46 so as to associate with a photodetector 47 which is supported by the framework. The rotational disk 45 is formed substantially circular but has a semi-circular protrusion 45*a* on the periphery thereof. The photodetector 47 has a U-shaped housing 47*a* having a passage 47*b*, in which the semi-circular protrusion 45*a* passes each rotation of the disk 45, between a pair of leg portions 47*c* and 47*d* on which a photoelectronic device (not shown) is incorporated. The photodetector 47 generates a speed signal indicative of the number of revolution of the disk, the number of which is generally proportional to the number of revolution of the disk 45 and, hence, the lower drum 2. The speed signal generated in the photodetector is supplied into the CPU 48, as shown FIG. 7.

The distributor 10 as described hereinbefore comprises an outer pipe and inner pipe rotatably mounted in the outer pipe. The outer pipe has at least one row of axially equally spaced perforations (not shown), while the inner pipe (not shown) has three groups of perforations, the perforations of each group being aligned in a row axially extending but positioned in different phase angle of 90 degree. The inner pipe is so designed to be rotated in the outer pipe about an axis thereof by a driving mechanism, which will be described in detail hereinafter, so that the row of perforations of each group may selectively coincide with the row of perforation of the outer pipe, and resulting in that the printing ink supplied in the inner pipe may emerges outwordly from the coinciding perforations of the inner and outer pipes onto the corresponding portion of the outer periphery surface of the lower drum 2, one end of the inner pipe protruding out of the corresponding end of the outer pipe and being fluid-coupled to the discharge port of the pumping unit 11.

Figure 6A:
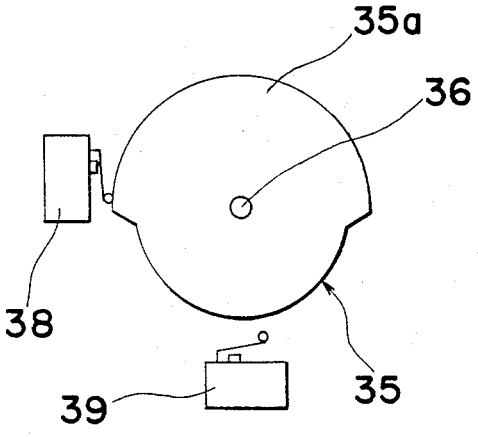
FIGS. 6*a*,6*b* and 6*c* are explanatory views respectively showing the operation of a cam plate and limit switches shown in FIGS. 1 and 2; and, FIG. 7 is a schematic block diagram showing an ink detecting device employed in the rotary printing machine in FIGS. 1 and 2.
Figure 6B:
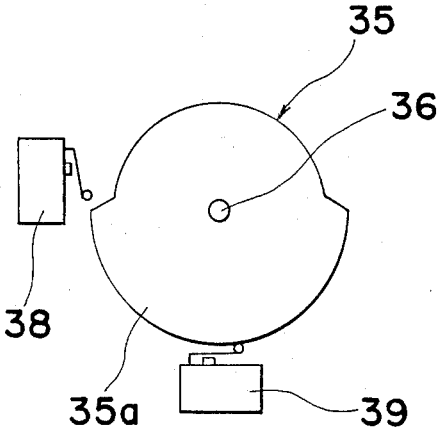
Figure 6C:
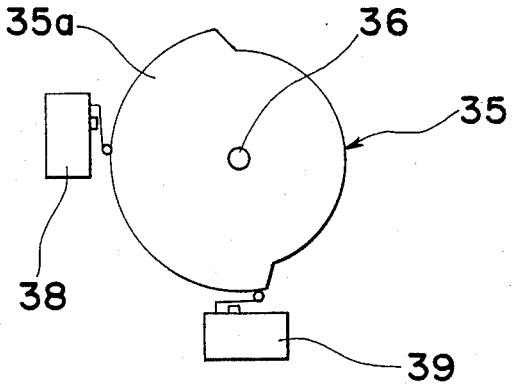

The driving mechanism for driving the distributor 10 comprises a plate cam 35 rotatably supported by the machine framework, connected with a cam plate driving means (not shown) and having a pin 36 fast therewith, the pin 36 being rotatably connected with a lower end of a substantially V-shaped arm 37. An upper end of the arm 37 is rotatably connected with a lower end of a link 34 by means of a pin 36*a*, while an upper end of the link 34 is secured to the protruding end of the inner pipe. Thus, when the plate cam 35 is rotated by some angle by the actuation of the cam plate driving means, the inner pipe of the ink distributor 10 is consequently rotated by the same angle, the actuation of the cam plate driving means being controlled by a control output signal supplied from the CPU 48. The rotational position of the plate cam 35 and, hence, the rotational position of the inner pipe of the ink distributor 10 is detected by a pair of limit switches 38 and 39 arranged around at the plate cam 35 and supported by the framework. As seen in FIG. 2, one of the switches 38 is laterally positioned at the left side of the plate cam 35, while the other switch 39 is positioned below the plate cam 35. Meanwhile, the plate cam 35 to be associated with the limit switches is of the substantially same shape as the rotational disk 45, namely substantially circular and has a semi-circular protrusion 35*a* around the periphery thereof. FIGS. 6*a*, 6*b* and 6*c* respectively indicate the rotational positions of the plate cam 35. When the plate cam 35 takes the position shown in FIG. 6*a*, the inner pipe of the ink distributor 10 is so positioned that only the perforations belonging to the intermediate group coincide with the perforations of the outer pipe. Thus, the printing ink in the inner pipe may emerge onto only the intermediate portion of the outer peripheral surface of the lower drum 2 which the intermediate sensor roll 13*c* contacts. Meanwhile, when the plate cam 35 takes the position shown in FIG. 6*b*, the inner pipe of the ink distributor 10 is so positioned that only the perforations belonging to the left group, viewed in FIG. 1, coincide with the perforations of the outer pipe. Thus, the printing ink in the inner pipe may emerge onto only the left portion of the outer peripheral surface of the lower drum 2 which the left sensor roll 13*b*, viewed in FIG. 3, contacts. Likewise, when the plate cam 35 takes the position shown in FIG. 6*c*, the printing ink in the inner pipe may emerge onto only the right portion of the outer peripheral surface of the lower drum 2 which the right sensor roll 13*d* contacts. The plate cam 35 in the position indicated in FIG. 6*a* actuates only one of the switches 38 in such manner that the protrusion 35*a* of the plate cam 35 depresses the actuator of the switch 38. The switches 38 and 39 respectively supply signals indicative of the rotational position of the plate cam 35 to the CPU 48, as shown in FIG. 7. Meanwhile, when the plate cam 35 takes the position shown in FIG. 6*b*, the protrusion 35*a* of the plate cam 35 actuates only the other switch 39, and further when the plate cam 35 takes the position shown in FIG. 6*c*, the protrusion 35*a* simultaneously actuates both of the switches 38 and 39, and resulting in such that the position signals indicative of the rotational position of the plate cam 35 are supplied to the CPU 48.

It is to be noted that the sensor roll 13*b*, 13*c* and 13*d* are rotated due to the frictional contact with the lower drum 2 through the ink layer, thus, the slip between the sensor rolls and the lower drum causes the rotational speed of the sensor rolls to decrease. Moreover, the ink layer on the outer peripheral surface of the lower drum 2 is a very important cause of said slip, and moreover, the slippage of the sensor rolls is generally a function of the thickness of the printing ink layer (the quantity of the ink) on the lower drum 2. According to the present invention, the quantity of the ink on the divided three portions of the lower drum 2 can be separately known by the detection of the rotational speed of the each sensor rolls 13*b*, 13*c* and 13*d*, and subsequently the printing ink is replenished from the ink distributor 10 onto the corresponding portions of the lower drum 2 the quantity of the ink on which has decreased below the predetermined value. The operation of the ink detecting device as described above will be in detail hereinbelow.

Assuming that the printing work is being performed, the printing ink retaining on the outer peripheral surface of the lower drum 2 is consumed and the quantity thereof decreases with increase of the number of prints being made. As the quantity of the retaining ink decreases in the manner described above, the slippage of the sensor rolls 13*b*, 13*c* and 13*d* relative to the divided portions of the outer peripheral surface of the lower drum 2 decrease. It is to be noted that, since the consumption of the ink on the divided portions of the outer peripheral surface of the lower drum 2 is generally different to each other according to the image provided on the stencil paper. During the rotation of the drums 1 and 2, the photodetector 47 constantly supplies the speed signal or constant electrical pulse indicative of the rotational speed of the disk 45 and, hence, the lower drum 2 to the CPU 48, while each hall element 41*b*,41*c* and 41*d* in the fixed shaft 14 supplies the speed signal indicative of the rotational speed of each of the sensor rolls 13*b*, 13*c* and 13*d* to the CPU 48. Each proportion of the rotational speed of each sensor drum 13*b*,13*c* and 13*d* with respect to the reference value, which indicates the rotational speed of each of the sensor rolls measured under such a condition that no ink is applied onto the drums 1 and 2, is successively calculated in the CPU 48. It is now assumed that the photodetector 47 generates, for example, a pulse per a rotation of the buck-up screen 3 and the sensor rolls 13*b*, 13*c* and 13*d* respectively rotate, for example, eighteen times during an interval between the pulses under such a condition that no ink is applied onto the outer peripheral surface of the lower drum 2, moreover the optimum proportions of the rotational speed of each sensor drums 13*b*, 13*c* and 13*d* with respect to the reference value takes the value as indicated in the following table 1.

TABLE 1

| Mode | Rotational speed of drum 2 | Optimum proportions of the rotational speed of sensor rolls to the reference value: Right and left sensor rolls 13b, 13d | Intermediate sensor roll 13c |
|---|---|---|---|
| 1 | 40 rpm | 10/18 | 11/18 |
| 2 | 55 | 11/18 | 12/18 |
| 3 | 75 | 12/18 | 13/18 |
| 4 | 100 | 13/18 | 14/18 |
| 5 | 130 | 13/18 | 14/18 |

Referring to above table 1, it is to be noted that the optimum proportions respectively take inherent values according to the rotational speed of the lower drum 2, moreover the optimum proportions regarding the right and left sensor rolls and the optimum proportion regarding the intermediate sensor roll take different values even when the rotational speed of the lower drum 2 is constant. Assuming now that, in above table 1, mode 1 is selected by using a device for selecting the rotational speed of the lower drum 2 (not shown), when the right sensor roll 13*b* rotates more than ten times per a rotation of the buck-up screen 3, it is known that the quantity of the printing ink on right portion of the outer peripheral surface of the lower drum 2 is consumed so that the printing ink should be replenished from the ink distributor 10. In such a case, a corresponding control output signal is first supplied from the CPU 48 to the plate cam driving means 60 shown in FIG. 7 for rotating the plate cam 35 and, hence, the inner pipe of the ink distributor 10 so that the rotational position of the inner pipe is so set as to open the corresponding group of the perforations for replenishing the printing ink onto the corresponding portion of the drum 2 in shortage of the printing ink, for example the right portion, and subsequently another control output signal is supplied from the CPU 48 to the solenoid unit 25 so that the plunger 25*a* thereof is so energized as to actuate the pumping unit 11 accompanied the printing ink in the inner pipe of the ink distributor 10 emerging onto the corresponding portion of the outer peripheral surface of the drum 2 in shortage of the printing ink. When the rotational speed of the right sensor roll 13*b* increases above the reference value (ten times of rotation), the CPU 48 ceases the generation of the control output signal and the solenoid unit 25 is therefore deenergized to interrupt the pumping of the printing ink onto the lower lower drum 2.

While the ink detecting device according to the present invention is constructed as hereinbefore described, it is to be noted that the slippage of the sensor roll 15 relative to the drums 2 is in practice affected by the following parameters and is not, therefore, fixed at all times:

(a) The condition of the outer peripheral surface of any one of the sensor rolls 13*b*, 13*c* and 13*d* 15 and the lower drum 2.

(b) The condition of the contact of the sensor rolls 13*b*, 13*c* and 13 *d* with the drum 2.

(c) The resistance against to the rotation of the sensor rolls 13*a*, 13*b* and 13*d* by the bearing members.

(d) The viscosity of the printing ink used.

(e) The rotational speed of the lower drum 2, that is, the number of prints to be produced per minute.

Of these parameters, the parameters (a) to (d) are generally fixed within a predetermined range depending on the design of the printing machine and/or the type of the printing ink actually used. With respect to the parameter (e), the adjustable range of the number of prints to be produced per minute is 1:3 to 1:4.

Therefore, even though the change in slippage of the sensor rolls 13*b*,13*c* and 13*d* resulting from one or a combination of these parameters is taken into consideration, the ink detecting device according to the present invention is effectively utilizable in practice with the retaining ink quantity being satisfactorily controlled to the optimum value.

From the foregoing description, it has now become clear that the above embodiment according to the present invention utilizes the change in number of revolution of a plurality of sensor rolls respectively resulting from the relative slip between the sensor rolls and the lower drum, the slippage of the sensor rolls being a substantial function of the quantity of the retaining printing ink on the drums, for enabling the ink detecting device to generate the control output signal necessary to operate the ink supply unit to compensate for the reduction in quantity of the printing ink standing on the lower drum. Accordingly, with the ink detecting device according to the present invention, since the detection of the ink quantity is performed direct at the outer peripheral surface of the drum and since the control output signal is generated when the quantity of the retaining ink decreases below the lowermost limit of the optimum range of the ink quantity, the printing ink retaining on the outer peripheral surface of the drum can advantageously be kept within the optimum range of the ink quantity with the consequence that the image can be printed uniformly on the papers. In addition, since the detection of the ink quantity is performed at three portions of the outer peripheral surface of the lower drum so that the ink quantity on each portion of the lower drum can be separately controlled, the image can be printed uniformly on a paper at any parts thereof, i.e. right, left and intermediate part of a paper.

Meanwhile, it is well known that the viscosity of the printing ink become larger according to the decrease of the atmospheric temperature so that, when the atmospheric temperature and, hence, the temperature of the printing ink is lower than normal, the printing ink is required to be replenished much more than normal. In such case, the ink detecting device according to the above embodiment of the present invention is advantageous in that, since the slippage between the sensor rolls and the lower drum generally decreases according to the increase of the viscosity of the printing ink, the rotational speed of the sensor rolls correspondingly increases to permit the printing ink to emerge onto the outer peripheral surface of the lower drum.

Furthermore, according to the above embodiment of the present invention, since the sensor rolls are shiftable in the radial direction thereof with respect to the fixed shaft so as to contact with the outer peripheral surface of the lower drum under gravitation thereof, the contact pressure of the sensor rolls onto the lower drum are kept constant, thus resulting in that the thickness of the ink layer, namely the quantity of the ink layer can be detected due to the rotational speed of the sensor rolls in high reliability. Still further, since the spacers 13*a* are interposed between the adjacent sensor rolls so as to prevent the printing ink invading into the space between the sensor rolls and the fixed shaft 14 under the capillary phenomenon, the frictional condition between the sensor rolls and the fixed shaft can be kept constant so that the revolution of the sensor rolls can be maintained in the stable manner. Furthermore, since the sensor rolls are mounted on a single fixed shaft arranged inwardly of the buck-up screen, the construction for detecting the quantity of the printing ink applied onto the outer peripheral surface of the lower drum can be quite simple.

Although the present invention has fully been described in detail in connection with the preferred embodiment with reference to the accompanying drawings, it is to be noted that various changes and modifications are apparent to those skilled in the art. By way of example, although the ink replenishment onto each portion of the lower drum has been separately performed, the distributor may alternatively be of a design that, when ink shortage is simultaneously detected by the right and left sensor rolls, all of the perforations, at any of portions, formed in the outer pipe thereof are simultaneously opened so as to apply the printing ink onto all portions of the lower drum in order to rapidly resolving the ink shortage on the right and left portions of the drum. The number of the sensor rolls may alternatively be set two or more than three. Although the use of the sensor rolls has been made separate from the applicator rolls 15 and 49 in the above embodiment, one of the applicator rolls may be divided and concurrently used as sensor rolls. The sensor rolls may alternatively be so designed as to contact the outer peripheral surface of the upper drum or both of the upper and lower drums 1 and 2. The magnetic member for detecting the revolution of the sensor rolls may mounted on a suitable member around the sensor rolls, for example, the framework. Furthermore, the means for detecting the rotational speed of the sensor rolls and the drum 1 or 2 may be respectively replaced by the other devices, for example voltage generator generating voltage substantially proportional to the rotational speed thereof.

Accordingly, such changes and modifications are to be understood as included within the scope of the present invention as defined by the appended claims, unless they depart therefrom.

What is claimed is:

1. For use in a rotary printing machine comprising at least one printing drum supported for rotation, an image carrier medium having an image area bearing an image to be printed on an image supporting material, and an ink supplying means to selectively supply a proper quantity of a printing ink onto desired portions of the outer periphery of the printing drum, in an axial direction thereof, said printing ink on the outer periphery of the printing drum being, during the rotation of the printing drum, allowed to penetrate through the image area of the image carrier medium to the image supporting material, an ink detecting device which comprises, in combination:

a plurality of sensor rolls rotatably supported in series on a single fixed shaft in frictional contact with the printing drum through a layer of printing ink interposed between said sensor rolls and said printing drum;

a first means for separately detecting rotational speed of each sensor rolls;

a second means for detecting rotational speed of the printing drum;

a control means for comparing the rotational speed of each sensor roll and corresponding reference values respectively indicative of rotational speed of each sensor roll measured under such a condition that optimum quantity of printing ink is applied on the outer periphery of the printing drum, and accordingly controlling said ink supplying means so as to replenish the printing ink onto desired portions of the outer periphery of the printing drum which correspond to such sensor rolls the rotational speed of which exceeds the corresponding reference values.

2. A device as claimed in claim 1, wherein said sensor rolls are mounted on said fixed shaft with a space of at least 1 mm maintained therebetween.

3. A device as claimed in claim 1, wherein each of said sensor rolls is so mounted on the fixed shaft as to be radially shiftable and so as to contact the corresponding portion of the outer periphery of the printing drum under gravitation.

4. A device as claimed in claim 1, wherein said first means comprises magnetic members fixedly mounted on each of the sensor rolls, and magnet sensors being sensitive to said corresponding magnetic members and supported on supporting members positioned adjacent to each of said sensor rolls for supplying a speed signal indicative of the rotational speed of each sensor roll to said control means.

5. A device as claimed in claim 4, wherein said fixed shaft is of pipe-shaped, and said magnet sensors are respectively fixedly mounted on an inner surface of said fixed shaft.

6. A device as claimed in claim 4, wherein said magnet sensors are of hall elements.

7. A device as claimed in claim 1, wherein said second means comprises a rotational disk being so designed as to be rotatably driven by the printing drum and having a protrusion therearound, and a photodetector for detecting rotational speed of the rotational disk and, hence, the printing drum with the protrusion of said rotational disk associating.

* * * * *